United States Patent [19]

Guntermann et al.

[11] 4,389,015

[45] Jun. 21, 1983

[54] CORRUGATION-FREE RAIL

[75] Inventors: Hans Guntermann; Gerhard Arndt, both of Essen; Gustav Baum, Frankfurt am Main, all of Fed. Rep. of Germany

[73] Assignee: Elektro-Thermit GmbH, Fed. Rep. of Germany

[21] Appl. No.: 159,640

[22] Filed: Jun. 16, 1980

[30] Foreign Application Priority Data

Jul. 11, 1979 [DE] Fed. Rep. of Germany ..... 2927890

[51] Int. Cl.[3] ..... B22D 19/00

[52] U.S. Cl. ..... 238/150; 75/126 C; 75/126 Q; 164/54; 228/241; 249/86; 428/683

[58] Field of Search ..... 238/150, 148, 140, 50, 238/143; 164/54, 92, 98, 332; 249/86; 228/241; 428/683, 685; 148/39; 75/126 C, 126 Q

[56] References Cited

U.S. PATENT DOCUMENTS 1,511,111 10/1924 Critchett ..... 238/150

1,752,566 4/1930 McClary ..... 238/150

4,185,773 1/1980 Blanc et al. ..... 238/150

*Primary Examiner*—Richard A. Bertsch

*Attorney, Agent, or Firm*—James E. Bryan

[57] ABSTRACT

The invention concerns a corrugation-free rail for track-bound vehicles. In the invention, the rail comprises a metallic material in the area of the travel and/or guide surfaces of which the stress limit or yield point is above the wheel-induced compression. Preferably, the rail in the area of the travel and/or guide surfaces is composed of a non-work-hardenable material.

The preferred material composition is (by weight):

| | |
|---|---|
| carbon | 0.2 to 0.4% |
| chromium | 13 to 18% |
| molybdenum | 0.3 to 1.5% |
| manganese | 0.5 to 1.5% |
| silicon | 0.3 to 1% |
| remainder is iron. | |

2 Claims, No Drawings

CORRUGATION-FREE RAIL

The present invention concerns a rail for track-bound vehicles and free of corrugation-forming tendencies.

In all track rails, the maintenance of a problem-free running and guiding surface of the rail assumes an important role, the formation of corrugations being especially significant.

Corrugations are periodic irregularities on the rail surface, with wave lengths of about 30 to 60 mm and amplitudes up to about 0.4 mm; they appear mostly on the travel surface in the form of more or less uniform, glossy peaks and troughs. These corrugations decrease traveling comfort and contribute substantially to the stresses experienced by the vehicles and the superstructure. They cause a premature degradation of the track conditions and considerably increase noise emission.

To date, the causes or origins of the corrugations are largely beyond research and so far no reliable palliatives or precautions to prevent the formation of corrugations are known. To decrease the damaging effects, so far only the grinding of the surfaces with corrugations constitutes the single effective step to eliminate them. Grinding the corrugations substantially shortens the emplacement life of the rails and requires high grinding costs, especially because following grinding, the corrugations soon appear again.

A number of methods and steps were tested to prevent the formation of corrugations. For instance, it has been proposed to anneal corrugation-susceptible rails to eliminate stresses that were held responsible for the occurrence of corrugations. Further an attempt has been made to eliminate the formation of corrugations by metallurgical steps in the manufacture of the rail steels, especially as regards eliminating or lowering the presence of non-metallic elements in rail steels. Again, German Pat. No. 1,903,753, proposes to remelt in part or in whole rails susceptible to corrugations or beset with them in the region of the travel and/or guide surfaces, the remelting or fusion being carried out electrically using an electric arc between the rail to be treated and an electrode which may be used up or not. All these methods or steps in the long run failed to meet with the desired success. Even steps for reducing wear, in which the travel and/or guide surfaces preferably are made of welded-on, austenitic materials, failed to properly affect the formation of corrugation.

The scope of diverse theories regarding the cause and elimination of corrugation is shown in the book "Die Eisenbahnschiene", Wilhelm Enrst & Sohn Publishers, issued by Fritz Fastenrath, 1977. The most diverse causes of corrugations are discussed from page 256 to 288. Significantly, most recent reseach, for instance the project "Researching the limits of the wheel-rail system", includes the effect of steel composition of the rail in the preliminary research on corrugation. In particular, on page 271 of the above text, the following rails are cited:

a rail made from pearlitic steels with 0.7% carbon and about 1% each of manganese and chromium;

a rail made of austempered steels with 0.3% carbon and 2.5% chromium;

a rail made from low-carbon steels with 0.07% carbon and 4.5% manganese;

a rail made from austenitic steels with manganese contents exceeding 10%.

From all of this research, surmise and theory, only one conclusion may be drawn, that to date no satisfactory solution to the corrugation problem has been found. There remains as acute a need as ever to discover a rail which is not prone to corrugations. The solution of this problem is the object of this invention.

The rail of the invention is without tendency to corrugate and comprises a metallic material in the area of the travel and/or guide surfaces with a limit of elongation, or stretching, above the surface compression caused by the wheel.

Now it was discovered to be very advantageous when the rail in the area of the travel and/or guide surfaces is composed of a material which is not cold-work strain-hardenable.

Suitable materials were found to be alloying materials which in the welded condition exhibit martensitic structures with hardnesses from 40 to 60 Rockwell C. and yield points much above the compressions caused by wheels. Suitable additive materials may be of the following compositions (by weight):

| | |
|---|---|
| carbon | 0.2 to 0.4% |
| chromium | 13 to 18% |
| molybdenum | 0.3 to 1.5% |
| manganese | 0.5 to 1.5% |
| silicon | 0.3 to 1% |
| remainder is iron | |
| or | |
| carbon | 0.4 to 0.6% |
| cromium | 8 to 11% |
| silicon | 3 to 4% |
| remainder is iron. | |

The manufacture of the corrugation-free rail of the invention can be implemented in a variety of ways. Electrical surface build-up welding was found especially suitable in making such a rail. In this procedure, the rail is cleared mechanically or using an oxyacetylene torch to a depth of about 2 to 3 mm and a width about 20 to 30 mm in the area of the travel and/or guide surfaces, and the clearances are filled with a welding material of corresponding composition. Thereafter, the rail is worked to the proper contour. It is also possible to deposit welding material in the absence of a clearance and to grind it to the proper travel conditions, so that the welding seam projects above the rail contour proper.

However, it is also possible to roll or even to bond bar-shaped materials of corresponding composition to the rail in known manner. Again, it is possible to spray on materials of corresponding composition and properties using known processes.

It is furthermore possible to so raise the yield points and stress limits of typical rail steels in the areas of the travel and/or guide surfaces by heat-treating that they will be above the wheel-induced compressions. The plasma electric arc is particularly suited to this end, as it allows rapid heating with ensuing accelerated cooling.

Regardless of the specific procedure, it is essential that work zones be created of which the yield points and stress limits in the area of travel and/or guide surfaces will be above the wheel induced compressions.

Comprehensive experiments and runs with the rail of the invention have shown that no corrugations appear even after a lengthy time of observation, while corrugations clearly formed in rails on a parallel track of known composition and conventional strain-stress limits. An experiment also was carried out, whereby a rail of the invention replaced a substantially long and corrugated rail segment, whereupon the adjoining, remaining, corrugated rails were ground level. Already a short time thereafter it was found that the rail of the invention remained free of corrugations whereas the adjoining rails again corrugated. The same result obtained when new rails of conventional composition in lieu of the corrugated and then ground-off rails were alternatingly laid with the rails of the invention. The conventional rails evidenced corrugation; the rails of the invention laid in between showed none within the time of observation.

The rails of the invention therefore are particularly suitable for those rail segments which are under particular load and from which pronounced corrugation can be expected.

It will be obvious to those skilled in the art that many modifications may be made within the scope of the present invention without departing from the spirit thereof, and the invention includes all such modifications.

What we claim is:

1. A corrugation-free rail for track-bound vehicles which comprises, at least in part of the area adapted to be contacted by a wheel, a metallic material having a martensitic structure, a hardness of 40 to 60 Rockwell C, and the following composition, by weight:

| | |
|---|---|
| carbon | 0.2 to 0.4% |
| chromium | 13 to 18% |
| molybdenum | 0.3 to 1.5% |
| manganese | 0.5 to 1.5% |
| silicon | 0.3 to 1% |
| remainder is iron. | |

2. A corrugation-free rail for track-bound vehicles which comprises, at least in part of the area adapted to be contacted by a wheel, a metallic material having a martensitic structure, a hardness of 40 to 60 Rockwell C, and the following composition, by weight:

| | |
|---|---|
| carbon | 0.4 to 0.6% |
| chromium | 8 to 11% |
| silicon | 3 to 4% |
| remainder is iron. | |

* * * * *